United States Patent [19]

Klem

[11] 4,397,348

[45] Aug. 9, 1983

[54] RADIATOR BAFFLE

[75] Inventor: John E. Klem, Waukegan, Ill.

[73] Assignee: Dresser Industries, Inc., Dallas, Tex.

[21] Appl. No.: 244,353

[22] Filed: Mar. 16, 1981

[51] Int. Cl.[3] ..... F28F 9/22

[52] U.S. Cl. ..... 165/41; 165/122; 123/41.49; 180/68 R

[58] Field of Search ..... 165/41, 122; 123/41.49, 123/41.04, 41.6; 180/54 A, 68 R

[56] References Cited

U.S. PATENT DOCUMENTS 4,076,072 2/1978 Bentz ..... 165/41

4,137,982 2/1979 Crews et al. ..... 165/41

4,213,426 5/1980 Longhouse ..... 165/122

*Primary Examiner*—Albert W. Davis, Jr.

*Assistant Examiner*—John F. McNally

*Attorney, Agent, or Firm*—B. E. Deutsch

[57] ABSTRACT

A vehicle heat exchanger system having air stream suppressing baffles detachably mounted in top and lateral and bottom clearance spaces formed by transverse top and lateral vertical sides of an air plenum and a draped enclosure structure and by a transverse bottom side of the plenum and a transverse member of the vehicle chassis frame.

20 Claims, 8 Drawing Figures

FIG. 3
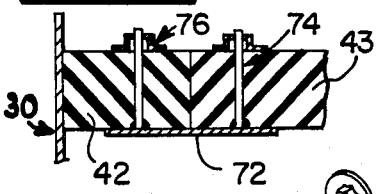
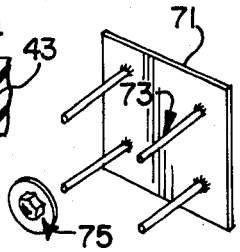
FIG. 4
FIG. 5
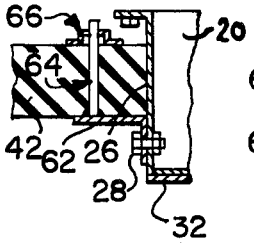
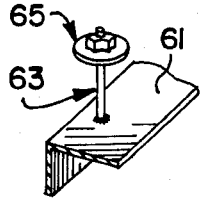
FIG. 8
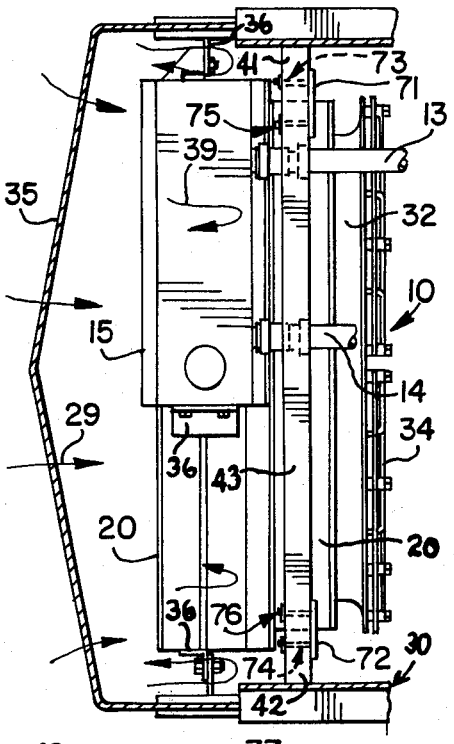
FIG. 6
FIG. 1
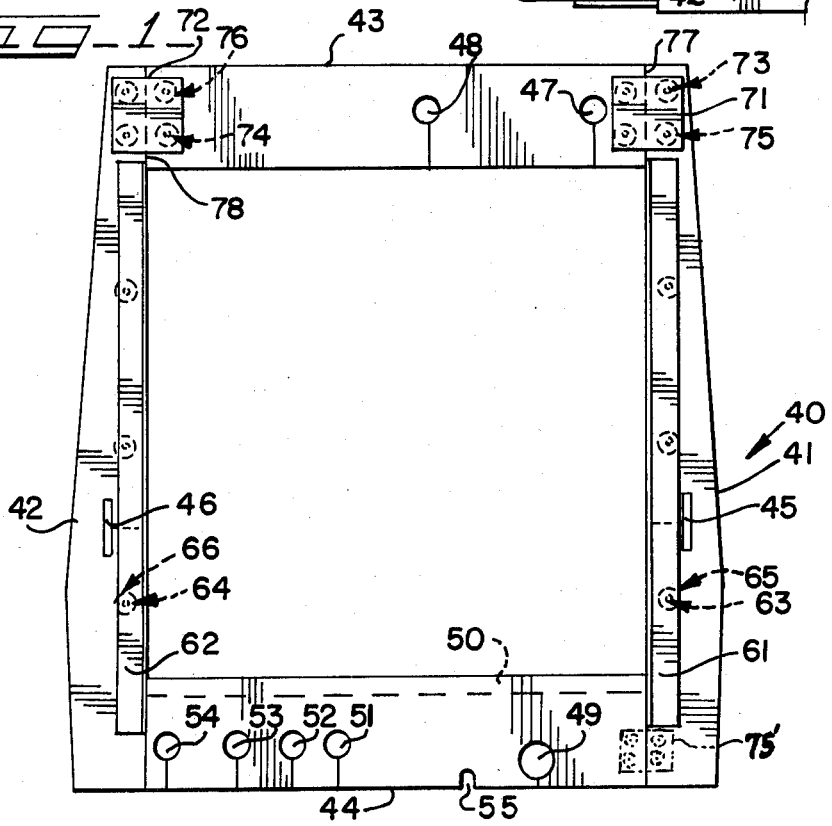

RADIATOR BAFFLE

This invention relates to heat exchanger devices for use in materials handling vehicles, and in particular to an arrangement of detachably retaining air stream suppressing material between the outer perimeters of the components of the vehicle heat exchanger systems and the inner surfaces of the enclosures draped over the heat exchanger components and the cross beams of the vehicle chassis frames.

Heretofore, various spaces between the outer perimeters of the heat exchanger support frames and the inner surfaces of the grille and radiator enclosures were not sealed completely from the fan induced cooling air stream passing through the grille prior to being drawn through the heat exchanger devices. Consequently, a portion of the fan induced cooling air stream was aspirated through these spaces by the pressure differential between the air intake and discharge sides of the heat exchanger devices, thereby lowering the efficiency of the heat exchanger devices.

My invention seals or closes these undesirable spaces so that all of the fan induced cooling air is substantially drawn through the heat exchanger devices thereby raising the efficiency of their cooling.

A typical present day materials handling vehicle is shown in U.S. patent application Ser. No. 207,105, filed on Nov. 17, 1980, by Thomas W. Kerkman and assigned to the International Harvester Company. The vehicle has a chassis frame supporting an engine coolant heat exchanger system, which generally comprises: an engine driven fan, a bell-shaped fan shroud encircling the fan, such as is shown in U.S. Pat. No. 3,872,916—Beck—Mar. 25, 1975, an air plenum connected to the air intake side of the fan shroud, a heat exchanger support frame supported on a chassis frame cross member and connected to the air intake side of the plenum, a heat exchanger means carried within the confines of and connected to the support frame, an enclosure structure draped over the support frame and plenum and connected to the chassis frame, and a grille longitudinally spaced from the air intake side of the heat exchanger means and connected to the enclosure structure and to the chassis frame. My invention improves the vehicle heat exchanger system by detachably retaining air stream suppressing material between the outer perimeters of the heat exchanger support frame and plenum, the cross member, and the inner surfaces of the enclosure structure. More specifically, the air stream suppressing material comprises a thick, resilient panel of elastomeric material, compressed between the outer periphery of the air plenum and inner surfaces of the enclosure structure and the upper surface of the cross beam. Due to the enormous size of the heat exchanger means in a materials handling vehicle, which is used in mining operations, it is preferable to divide the panel into manageable portions and to detachably mount the panel portions to the plenum exterior, which generally is an oblong box with vertical lateral flat sides, a transverse horizontal flat side and a transverse bottom sloping upwardly towards the air intake side of the fan shroud. The panel is divided into top, side and bottom portions. A pair of right angle members are respectively mounted, by one arm, upright, to each side of the plenum. The second angle arms are provided with a plurality of vertically spaced apart pins or studs, which pierce and impale the side panel portions. Spring nuts are provided for each of the angle arm pins and are pushed over the ends of the pins protruding from the impaled side panel portions detachably securing the impaled side panel portions to the second angle arms. The top and bottom panel portions are each provided with a plurality of holes or apertures to accommodate various pipes, hoses and tubes, which are connected to the top and bottom of the heat exchanger means. Two flat staple plates are each provided with at least two rows of a plurality of spaced apart pins or studs similar to those mounted on the exterior side of the second angle arms. The flat staple plates are mounted to the top and side panel portions with the two rows of pins stradling the juncture or union of the top and side panel portions, and are pressed or pushed through the top and side panel portions. Spring nuts are also provided for the staple plate pins and are pressed onto the protruding ends of each row of staple plate pins, detachably pinning and holding the top and side panel portion junctures together. The second angle arms pins and the staple plates pins are positioned to extend and pierce the top and side panels in the same direction and preferably in the direction towards the grille. The bottom panel portion sits upon the cross beam of the chassis frame and has a sloping edge which is wedged under the sloping bottom side of the plenum. The bottom panel portion is further held in place by the various pipes, tubes and hoses connected to the bottom of the heat exchanger means and passing through the aforementioned holes provided for this purpose in the body of the bottom panel portion. However, it is within the scope of my invention that the bottom panel portion can also be pinned to the side panel portions with a second set of the two flat staple plates, or it can be fastened to the bottom inclined wall of the plenum. It is also within the scope of my invention that the bottom panel portion may be made from an elastomer material, which is different from the elastomer material of the top and side panel portions, which preferably is a foam rubber. I propose that the bottom panel portion be made from a solid rubber, or other oil resistant elastomeric material, which will not readily absorb oil and other contaminants that may splash onto the cross beam of the chassis frame.

The various figures in the accompanying drawing illustrate a suitable arrangement for a constructive practice of my invention, wherein:

FIG. 1 is a view of the assembled air stream suppressing panel portions as viewed from the engine side of the materials handling vehicle;

FIG. 3 is a view taken in the direction of arrows 3—3 in FIG. 2 of the left side staple plate impaling the top and left side panels;

FIG. 4 is an isometric view of the right side staple plate and the common spring nut pressed on the pins of the right and left side staple plates;

FIG. 5 is a view taken in the direction of arrows 5—5 in FIG. 2 of the left side angle member impaling the left side panel;

FIG. 6 is an isometric partial view of the right side angle member showing one pin mounted to the exterior side of the second angle arm and the common spring nut pressed on the second angle arm pins of the right and left angle members;

FIG. 8 is a top view with portions cut away of FIG. 2.

Figure 7:
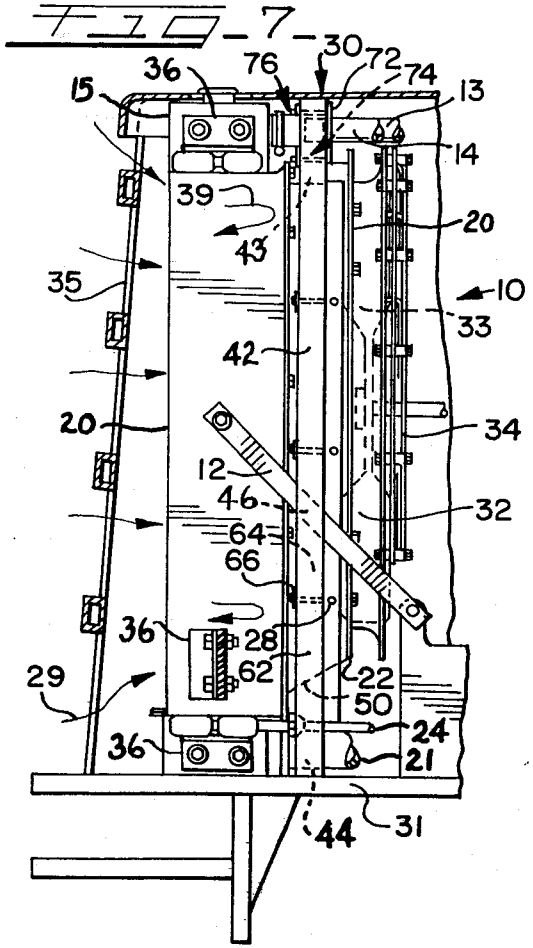
FIG. 7 is a side view, with portions cut away, of FIG. 2.
Figure 2:
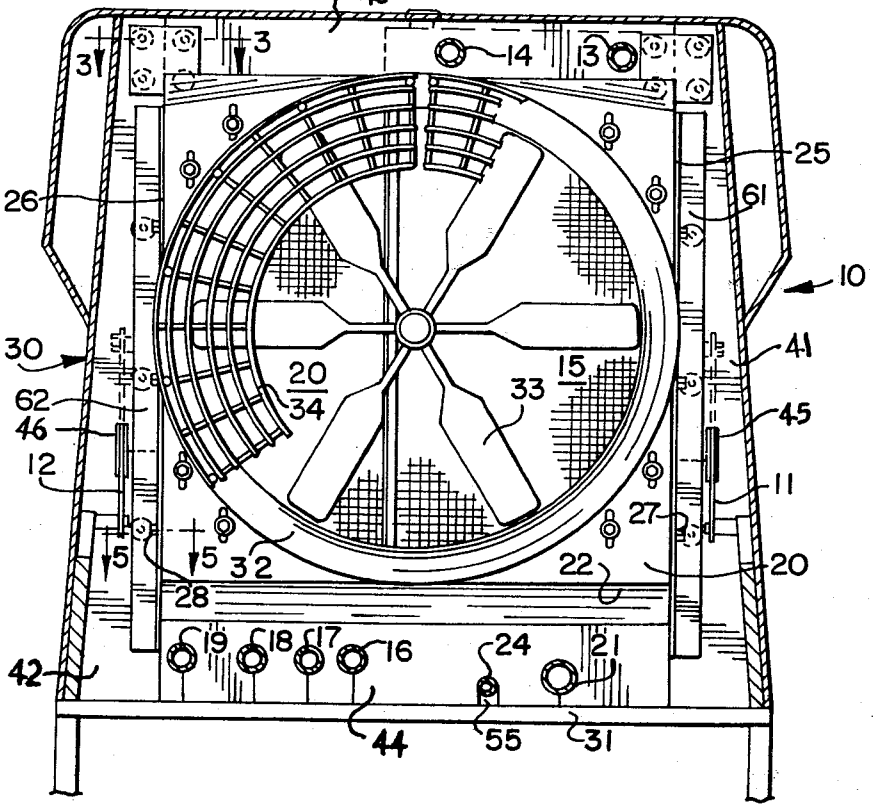
FIG. 2 is a view of the panel portions of FIG. 1 assembled in the engine compartment of the vehicle.

With reference now to the various figures of the drawing, wherein similar numerals refer to similar parts in the several views, an air stream suppressing baffle means is designated generally by the numeral 40 in FIG. 1 and is shown in combination with a vehicle heat exchanger system generally designated 10 in FIGS. 2, 7 and 8. The air stream suppressing baffle means 40 comprise right and left side baffle panel portions 41 and 42, and top and bottom baffle panel portions 43 and 44. The top and side baffle panel portions 41, 42 and 43 are preferably structured of an elastomeric material, such as foam rubber, having a high degree of surface conformability so that it will fill cracks and provide a better seal against the surrounding structure. The bottom baffle panel portion 44 is preferably solid rubber, or other oil resistant material, which will not readily absorb oil, coolant, or other liquid contaminants. The two side baffle portions 41 and 42 are each provided with right and left sloping rhombohedron shaped slots 45 and 46 through which pass the right and left heat exchanger frame support stabilizer bars 11 and 12 shown in FIGS. 2 and 7. The top baffle portion 43 is shown provided with two openings 47 and 48, which accommodate the two coolant hoses 13 and 14 shown in FIGS. 2, 7 and 8 connected to the top of the engine coolant heat exchanger means 15. The bottom baffle portion 44 is shown provided with four equal size openings 51, 52, 53 and 54, which accommodate the four hydraulic fluid lines 16, 17, 18 and 19 shown in FIG. 2 connected to a hydraulic fluid heat exchanger means 20. To the right of the four openings, a larger opening 49 is provided for the engine coolant return hose 21 connected to the bottom of the coolant heat exchanger means 15. A sloping edge 50 is provided along the upper side of the bottom baffle portion 44, which fits under the upwardly sloping transverse bottom 22 defining the lower wall of a plenum chamber. The plenum chamber is further defined by vertical siding 25 and 26 and top baffle portion 43. A notch 55 is provided in the bottom side of the bottom baffle portion 44 to the left of the coolant hose opening 49, which accommodates a coolant drain line 24. Right and left angle members 61 and 62 are fastened to the right and left side baffle portions 41 and 42 by means of the vertically spaced apart right and left pins 63 and 64, three of which are shown welded to the outer side of the transversely extending second arms of the angle members 61 and 62. The first arms of the angle members 61 and 62 are provided with three holes which accommodate the three right and the three left mounting bolts 27 and 28, shown in FIGS. 2, 5 and 7, which are used to mount the first angle arms upright to the right and left vertical side walls 25 and 26 of the plenum chamber. Three right and three left spring nuts 65 and 66 are pressed over the ends of the angle arm mounting pins 63 and 64 projecting through the impaled side panel portions 41 and 42 detachably pinning the right and left side baffle portions 41 and 42 to the outer sides of the second arms of the angle members 61 and 62. A right and a left flat staple plate 71 and 72 detachably pin the top baffle portion 43 to the right and left side baffle portions 41 and 42. Each staple plate 71 and 72 has two rows of two right and two left pins 73 and 74, which are positioned straddling the junctures 77 and 78 of the top and side baffle panel portions 43, 41 and 42. The two sets of quadruple right and left side staple plate pins 73 and 76 are pushed through the top and side baffle portions 43, 41 and 42 and are fastened thereto by the two sets of quadruple right and left side staple plate spring nuts 75 and 76 pushed over the protruding ends of the two sets of quadruple right and left side staple plate pins 73 and 74. Two additional sets of the quadripinned staple plates may be provided for pinning the bottom baffle portion 44 to the side baffle portions 41 and 42. Only the right side staple plate 75' is shown in dash-dot lines in FIG. 1.

As shown in FIG. 2, the assembled top, side and bottom baffle portions 43, 41, 42 and 44 are compressed between the plenum and the draped enclosure or surround structure 30 and the cross beam 31 of the chassis frame. The bell-shaped fan shroud 32 encircles the engine driven fan 33 and is connected to the air exit side of the plenum chamber. A protective screen 34 is attached to the radial flaring air discharge flange portion of the fan shroud 32.

As shown in FIGS. 7 and 8 the fan induced cooling air stream, represented by arrows 29, passes through the grille 35 and enters into the air intake sides of the engine coolant heat exchanger means 15 and the hydraulic fluid heat exchanger means 20. The small portion of the fan induced air stream, which would be aspirated through the clearance spaces between the heat exchanger support frame 36 and the draped enclosure structure 30, is represented by reverse arrows 39 deflected back into the intake sides of the heat exchanger means 15 and 20. Thus, the air stream suppressing baffle means 40 prevent the fan induced air stream 29 from branching and aspirating through the clearance spaces between the draped enclosure structure 30 and support frame 36 and the sloping bottom 22 of the air plenum and cross beam 31.

What is claimed is:

1. In a material handling vehicle having an engine mounted on a chassis frame, a coolant heat exchanger system comprising an engine driven fan, a bell-shaped shroud encircling the fan, wall means defining an air plenum connected to an air intake side of the shroud, a support frame mounted on a cross member of the chassis frame and connected to an air intake side of the wall means defining an air plenum, a heat exchanger means confined within and mounted to the support frame, an engine enclosure structure draped over the wall means defining an air plenum and support frame and mounted to the chassis frame, a grille longitudinally spaced from an air intake side of the heat exchanger means and connected to the enclosure structure and mounted to the chassis frame, and non-load-supporting top and side air stream supressing baffles comprising panels of elastomeric material having a high degree of surface conformability disposed in the clearance spaces between the transverse top and lateral vertical sides of the wall means defining an air plenum and the adjacent inner surfaces of said engine enclosure structure, and an air stream supressing bottom baffle disposed between the bottom portion of the wall means defining an air plenum and the cross member of the chassis frame, said top and side baffles forming a substantially complete air barrier between said wall means defining a plenum and said enclosure structure for suppressing aspiration of fan induced cooling air through the clearance spaces.

2. The vehicle heat exchanger system according to claim 1 or claim 12 or claim 19, wherein:

the bottom baffle panel is made from a non-liquid absorbing elastomeric material.

3. The vehicle heat exchanger system according to claim 1, wherein:

two structural upright beams are respectively connected to the lateral vertical sides of the air plenum and carry a plurality of vertically spaced apart pins on which the side baffle panels are impaled.

4. The vehicle heat exchanger system according to claim 3, wherein:

the structural beams are right angle members having one angle arm respectively connected to the lateral vertical sides of the air plenum and the pins connected to a second angle arm.

5. The vehicle heat exchanger system according to claim 4, wherein:

the second angle arm pins are mounted to an outer side of each second angle arm and face toward the grille.

6. The vehicle heat exchanger system according to claim 5, wherein:

second angle arm spring nuts are fastened to the second angle arm pins securing the impaled side baffle panels to the outer sides of the second angle arms.

7. The vehicle heat exchanger system according to claim 1, wherein:

the top baffle panel is detachably mounted to each of the side baffle panels by two laterally spaced apart staple plates, the staple plates having two spaced apart rows of pins impaling the top and lateral side baffle panels on opposite sides of a juncture between the top and lateral side baffle panels.

8. The vehicle heat exchanger system according to claim 7, wherein:

the two spaced apart rows of staple plate pins on each staple plate face toward the grille.

9. The vehicle heat exchanger system according to claim 8, wherein:

staple plate spring nuts are fastened over the rows of staple plate pins securing the impaled top and lateral side baffle panels to one another.

10. The vehicle heat exchanger system according to claim 1, wherein:

the transverse bottom of the air plenum slopes upwardly towards the air intake side of the shroud and the bottom baffle panel is provided with a beveled top edge engaging the sloping bottom of the air plenum.

11. The vehicle heat exchanger system according to claim 10, wherein:

the bottom baffle panel is provided with a plurality of holes through which pass a plurality of heat exchanger connected tubes and hoses.

12. The vehicle heat exchanger system according to claim 7, wherein:

the top baffle panel is provided with a plurality of holes through which pass a plurality of heat exchanger connected tubes and hoses.

13. The vehicle heat exchanger system according to claim 1, wherein:

two structural upright beams are respectively mounted to the lateral vertical sides of the air plenum, each upright beam carrying a row of vertically spaced apart pins piercing and pinning the side baffle panels to the respective upright beam.

14. The vehicle heat exchanger system according to claim 13, wherein:

the top baffle panel is bridged between and is stapled to the side panels.

15. The vehicle heat exchanger system according to claim 14, wherein:

the top baffle panel is stapled to the side baffle panels by two pin carrying plates respectively mounted across the junctures of the top and side baffle panels, each plate having a pair of pins spaced on opposite sides of the respective juncture piercing and pinning the top and side baffle panels together.

16. The vehicle heat exchanger system according to claim 15, wherein:

the pins on the upright beams and the pins on the plates are capped by spring nuts and face toward the grille.

17. The vehicle heat exchanger system according to claim 16, wherein:

the top and bottom baffle panels are provided with a plurality of openings through which pass heat exchanger connected tubes and hoses.

18. The vehicle heat exchanger system according to claim 17, wherein:

the bottom baffle panel is provided with a beveled top edge engaging a bottom side of the air plenum sloping upwardly towards the shroud.

19. The vehicle heat exchanger system according to claim 18, wherein:

the bottom baffle panel is bridged between and is stapled to the side panels by two additional pin carrying plates.

20. The vehicle heat exchanger system according to claim 9 or claim 16 or claim 19 wherein:

the plates are quadripinned.

* * * * *